US005090174A

United States Patent [19]

Fragale

[11] Patent Number: 5,090,174

[45] Date of Patent: Feb. 25, 1992

[54] SIDING SYSTEM INCLUDING SIDING TRIM PIECES AND METHOD OF SIDING A STRUCTURE USING SAME

[76] Inventor: Anthony J. Fragale, 26 4th St., McMechan, W. Va. 26040

[21] Appl. No.: 588,466

[22] Filed: Sep. 26, 1990

[51] Int. Cl.[5] ..... E04F 13/06

[52] U.S. Cl. ..... 52/309.9; 52/287; 52/288; 52/276; 52/309.8

[58] Field of Search ..... 52/242, 716, 287, 288, 52/276, 309.8, 309.9, 612; 156/333, 92; 428/901

[56] References Cited

U.S. PATENT DOCUMENTS

| | | | |
|---|---|---|---|
| 855,195 | 5/1907 | Marr . | |
| 1,521,938 | 1/1925 | Gartenberg | 52/278 |
| 2,033,752 | 3/1936 | Billingham | 52/612 |
| 2,089,005 | 8/1937 | Sherman et al. | 52/716 |
| 2,134,674 | 10/1938 | Sherman et al. | 52/376 |
| 2,716,260 | 4/1952 | Harper . | |
| 3,003,810 | 2/1956 | Kloote et al. . | |
| 3,228,818 | 1/1966 | Seby | 156/92 |
| 3,304,676 | 1/1964 | Sallie et al. | 52/276 |
| 3,415,019 | 12/1968 | Andersen | 52/94 |
| 3,415,028 | 12/1968 | Nerem | 52/281 |
| 3,496,058 | 2/1970 | Schroter et al. | 52/309.8 |
| 3,552,078 | 9/1968 | Mattes | 52/520 |
| 3,909,995 | 10/1975 | Bainter et al. | 52/631 |
| 3,969,868 | 7/1976 | Bainter et al. | 52/631 |
| 4,147,004 | 3/1979 | Day et al. | 52/309.9 |
| 4,189,885 | 2/1980 | Fritz | 52/309.1 |
| 4,195,460 | 4/1980 | Anderson et al. | 52/528 |
| 4,304,083 | 12/1981 | Anderson | 52/509 |
| 4,319,439 | 3/1982 | Gussow | 52/288 |
| 4,327,528 | 5/1982 | Fritz | 52/287 |
| 4,465,734 | 8/1984 | LaRoche et al. | 52/309.5 |
| 4,527,370 | 7/1985 | Schuette | 52/282 |
| 4,575,981 | 3/1986 | Porter | 52/530 |

FOREIGN PATENT DOCUMENTS

| | | | |
|---|---|---|---|
| 920803 | 3/1963 | United Kingdom | 52/309.8 |

OTHER PUBLICATIONS

Mastic brochure, "T-LOK Vinyl Siding".

ALCOA Brochure, "ALCOA Gutters and Downspouts".

*Primary Examiner*—James L. Ridgill, Jr.

*Attorney, Agent, or Firm*—Oliff & Berridge

[57] ABSTRACT

A siding trim piece has a low gauge layer (preferably metal) of preferably about 0.013 gauge, with a substrate material (preferably foam) laminated to the low gauge layer. An edge of the siding trim piece preferably has an integral J channel. The substrate material is fixed to the structure preferably by an adhesive. A method for siding a structure includes the steps of covering the trim, edges and corners in a structure with the siding trim pieces having an integral J channel, and covering the exterior surfaces with siding by inserting ends of the siding into the J channels of the siding trim pieces to abut the siding with the trim, edges and corners of the structure without interposing a separate intermediate seam covering material between the siding, corners, edges and trim. The invention provides a wood-like appearance and avoids the appearance of discontinuities between the siding and trim, edges and corners of the structure.

22 Claims, 5 Drawing Sheets

SIDING SYSTEM INCLUDING SIDING TRIM PIECES AND METHOD OF SIDING A STRUCTURE USING SAME

BACKGROUND OF THE INVENTION

1. Field of the Invention

The invention relates to a method of siding a structure using siding trim pieces that provide a decorative, wood-like and painted appearance. Preferably, the siding trim pieces have a foam layer laminated to a low gauge metal or aluminum layer of preferably 0.013 gauge (13 thousandths of an inch thickness) with the foam layer providing a porous surface which is fixed to the structure preferably by gluing the porous surface to the structure. Further, the invention relates to the above-described siding trim pieces having an integral J-channel and a method of siding a structure in which the siding trim pieces with integral J channels are first applied to the structure, and then siding panels are attached to the structure by inserting ends of the siding panels into the J channels. The invention eliminates the need for seam covering materials between the siding panels and discontinuities in the structure such as corners, edges and trim framed window or door openings, and thus provides a structure with a more uniform and attractive appearance.

2. Discussion of Related Art

Various types of siding panels and trim components are commonly used in siding construction. Whether the siding is aluminum, metal, plastic (typically polyvinylchloride or "vinyl"), plastic coated metal, or steel, trim and accessory components are necessary to cover surface discontinuities in the structure (such as window or door trim, corners, edges, etc.) and to install the siding panels on the structure to finish it. These trim components include window trim, door trim such as dentil molding and mantles, edge pieces, inside and outside corners, J channels, drip caps, starter strips, utility trim, facia, soffit and frieze trim, L channels, sill covers and various other types of trim molding.

Normal siding construction materials include siding panels for covering the exterior wall surfaces and siding trim pieces covering the trim which surrounds the surface discontinuities such as trimmed openings in the building for windows and doors. The trim piece is nailed to the structure. A J channel is then located between the siding panel and trim piece. Ends of the siding panels are normally secured to the structure by inserting them in J channels which not only support the ends of the siding panels, but also cover the rough edges of the siding panel ends to provide a smooth trim appearance. Often the window frame is covered with siding trim pieces and the J channel is located adjacent to the window trim for insertion of the ends of the siding panels. While satisfactory from a structural standpoint, locating the J channel between the window trim and the siding panel provides a nonuniform appearance since the J channel detracts from the continuity between the trim and siding panel. A similar aesthetic problem exists in locating a J channel between siding panels and door trim, between facia and soffits, between soffits and frieze boards, and between siding panels and structural corners or edges. Indeed, the aesthetic detraction of a separate J channel appears at any surface discontinuity in the siding panel.

To cover corners of the structure, it is known to use a corner trim piece having an integral J channel as disclosed in U.S. Pat. No. 3,304,676, or a channel member having opposing J and C channels in which a corner member is supported, as disclosed in U.S. Pat. No. 4,189,885. These patents, however, do not address the aesthetic difficulties when siding panels abut other trim components such as window and door trim. Further, when siding trim pieces have been installed on the building, it is often difficult (absent complete replacement) to replace those pieces with different colored or textured trim pieces.

In addition to the aesthetic detraction caused by J-channels, siding trim pieces can often further detract from the aesthetic appearance of a structure since the trim pieces often do not have a wood-like appearance. For example, even in a sided structure, the frieze board and/or fascia board often are not covered and remain with a wood exterior surface since siding products have not provided a smooth, painted, wood-like appearance for fascia and frieze boards. While siding products are available for soffits, these products have not provided a wood-like appearance, especially since the longitudinal length of the sided soffits extends between the fascia and frieze board, rather than extending for the length of the structure. Even if siding products are used for soffits, fascia and frieze boards, they also suffer from thermal expansion/contraction problems (discussed below) which disrupt the appearance of the structure.

Thermal expansion/contraction is another difficulty in siding construction since the siding expands and contracts in response to temperature changes. For structural stability, such panels are normally formed of relatively thick material having a high gauge of above 0.020. Often, the siding panels may include an insulating board attached by clips to the siding panels before they are installed, as disclosed in U.S. Pat. No. 3,304,676. Such panels, however, are then subject to significant thermal expansion/contraction. Uncontrolled expansion of siding panels can place undue loads on the J channels and possibly result in buckling of the panels. Uncontrolled contraction can result in withdrawal of the siding panel from the J channel.

SUMMARY OF THE INVENTION

It is an object of the present invention to provide a siding system and installation method which obviates the above-mentioned disadvantages of the prior art.

It is another object of the invention to provide a siding system an installation method which provides an aesthetic and uniform appearance even around building openings such as windows and doors.

It is a further object of the invention to provide a siding system and installation method which reduces thermal expansion/contraction difficulties.

These and other objects and advantages are obtained by the siding system and installation method of the present invention. In accordance with the present invention, a siding trim piece comprises a low gauge exterior layer having a gauge between 0.010 and 0.019, preferably 0.013; and a substrate material (preferably foam) laminated to the low gauge aluminum layer. Preferably, the exterior layer has an edge formed into a J channel. The substrate material has a porous interior surface which is fixed to the structure by an adhesive.

In accordance with another aspect of the present invention, a method for siding a structure having exterior surfaces with discontinuities, such as corners at intersections of the exterior surfaces, edges at ends of the exterior surfaces and openings with trim in the exterior surface such as trimmed windows and doors, comprises the steps of (a) covering the discontinuities including the trim, edges and corners in the structure with siding trim pieces having an integral J channel, and (b) covering the exterior surfaces with siding by inserting ends of the siding into the J channels of the siding trim pieces to abut the siding with the trim, edges and corners of the structure without a separate non-integral intermediate seam covering material between the siding and the corners, edges and trim. The present invention thus avoids discontinuities between the trim and siding.

BRIEF DESCRIPTION OF THE DRAWINGS

These and other objects and advantages of the present invention will become more apparent from the following detailed description of the preferred embodiments taken in conjunction with the drawings in which like elements bear like reference numerals and wherein.

DETAILED DESCRIPTION OF THE PREFERRED EMBODIMENTS

Figure 1A:
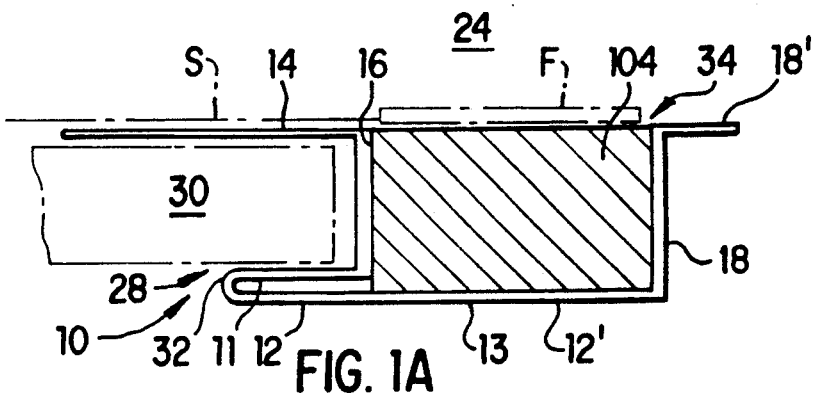
FIGS. 1A 1B and 1C are cross-sectional views of a siding trim piece having an integral J channel for use, for example, to trim a door frame.

FIG. 1A illustrates a cross-sectional view of the inventive trim strip component. The trim strip 10 can be used with any of the various types of siding construction in use today, and can be made of aluminum, metal, polyvinylchloride (vinyl), steel, plastic covered metal, or any other similar or compatible material. As will be understood by persons skilled in the siding construction field, the trim component will be manufactured in elongated thin strips and cut to an appropriate length for use at the building site. In this regard, the trim strip 10 can be molded, extruded or roll formed from a flat sheet.

The trim component 10 is preferably a sheet material having an exterior surface 13 and bent to have a front panel 12 and a rear panel 14 connected by a first transverse panel 16. The front and rear panels 12 and 14 are substantially parallel to each other while the transverse panel 16 is substantially perpendicular to each of the front and rear panels 12, 14. The front panel 12 includes an extension 12' which extends beyond the intersection of the transverse panel 16 and is connected to a second transverse panel 18 which is substantially parallel to the first transverse panel 16. The front panel 12 has a double layer 11 in one portion of the front panel because the sheet is bent back upon itself to form the double layer 11 of the front panel on one side of the first transverse panel 16. The second portion of the front panel 12 defined by the extension 12' projects toward the other side of the first transverse panel 16 to connect with the second transverse panel 18.

The panels 12, 14 and 16 form an integral J channel 28 which is adapted to receive the edges of a row of siding panels 30 (shown in phantom lines in FIG. 1A). As shown, the channel 28 opens outwardly in a direction along the surface of the building 24. A flange 32 may be formed at the outer end of the double layer 11 on the front panel 12 and turned in toward the rear panel 14 to ensure that the edges of the siding panels 30 are retained in the channel 28. The width of the channel 28 is predetermined relative to the size and shape of the siding panels 30.

The first and second transverse panels 16 and 18 and extension 12' form another channel 34 for covering discontinuities in the structure such as trim. For example, the trim channel 34 is used to surround a door frame F projecting from the surface S of the building 24. The panel 18 of the trim channel 34 may include an extension 18' for covering the edge of the frame. The length of the extension 18' varies depending on the trim to be covered. The trim channel 34 can be adapted in size or shape to accommodate any discontinuity in the exterior surface of the structure, such as window trim, and corners or edges of the structure. The trim channel 34 includes a foam layer 104 described below.

The trim piece 10 has the trim channel 34 and integral J channel 28, thus obviating the need for a separate intermediate J channel butted between the siding pieces 30 and the frame F. The integral J channel provides a uniform appearance extending from the siding panel 30 to the trim channel 34 via the front panel 12 and its integral extension 12' of the trim piece 10. This structure improves the aesthetic appearance of the sided structure by providing a uniform appearance which could otherwise be disrupted by an intermediate nonintegral J channel between the siding panel 30 and the trim channel 34.

Figure 1B:
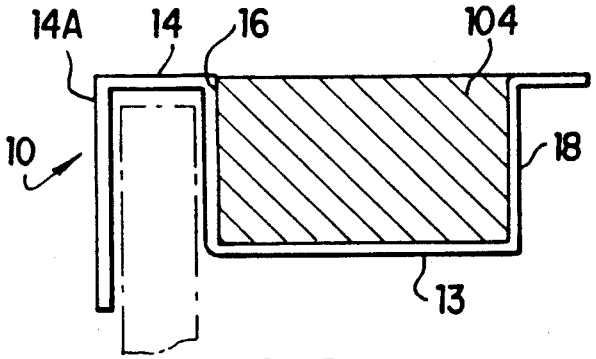
Figure 1C:
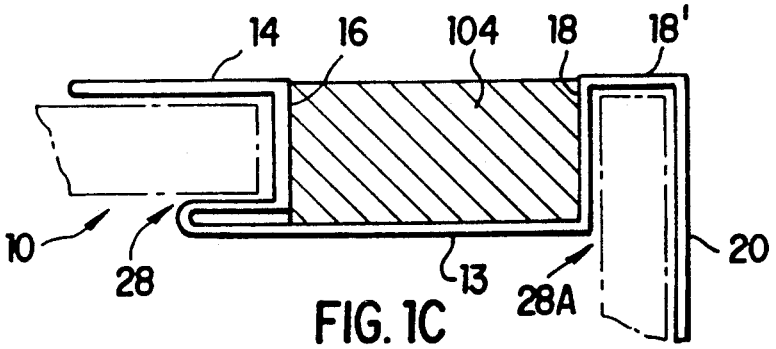
Figure 1D:
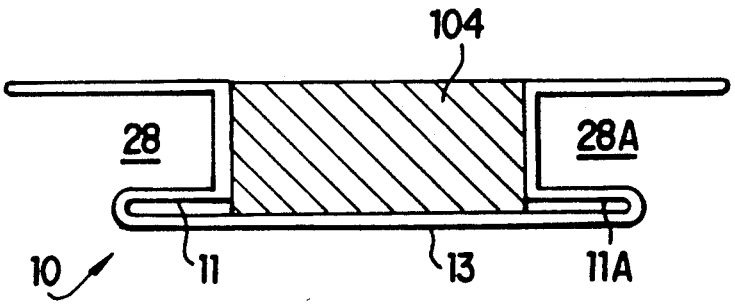

In FIG. 1A, the channel 28 opens outwardly in a first direction along the surface of the building 24 to be covered by the trim channel 34. However, the channel 28 may open in a second direction transverse to the first direction by eliminating the double layer 11. For example, as illustrated in FIG. 1B, the channel 28 opens in a second direction perpendicular to the surface of the building to be covered by the trim channel. An extension 14' is formed in the rear panel 14 to define the channel 28. Further, as illustrated in FIG. 1C, the siding trim piece 10 of FIG. 1A may include a second J channel 28A extending in the second direction by providing a third transverse panel 20 extending from the extension 118' and parallel to the second transverse panel 1B. Alternatively, as illustrated in FIG. 1D, the siding trim piece may include a second J channel extending in the same direction as the first J channel 28 (i.e., in the first direction) by forming a second double layer 11A.

Figure 2:
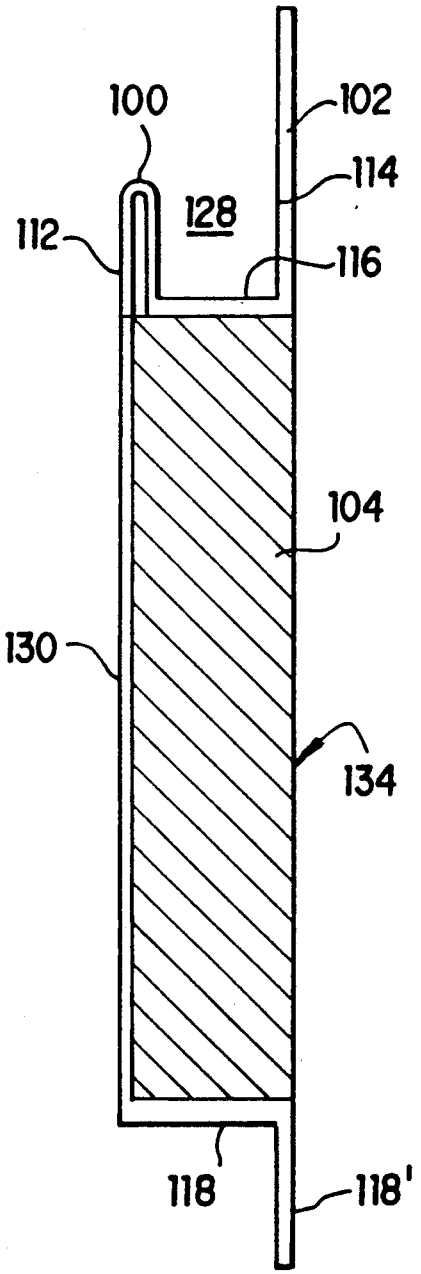
FIG. 2 is a cross-sectional view of a laminated siding trim piece in accordance with another aspect of the present invention.

FIG. 2 is a cross-sectional view of an enlarged siding trim piece 100. The piece 100 is constructed like the trim piece 10 of FIGS. 1A–1D, but with an enlarged trim channel 134 to cover different types of trim such as fascia boards, as detailed below. The trim piece 100 preferably includes an integral J channel 128 similar to the J channel 28 of the trim piece 10 described with reference to FIG. 1A-1D. As illustrated in FIG. 2, the panel 100 has an exterior face 130, one end of which is formed into an integral J channel 128 by bending back a portion of the exterior face 130 to form a front panel 112, a transverse panel 116 and a rear panel 114. The opposite end of the panel 100 is bent to form another transverse panel 118 with its extension 118'.

The trim piece 100 includes an exterior layer 102 made of light material, preferably metal having a gauge of 0.01 to 0.019, but preferably 0.013. The exterior surface of the light gauge material can be embossed with a woodgrain, painted in any color and-or striated with a colored PVC coating. A substrate material, preferably a foam insulating material 104, is laminated in the trim channel 134 on the inside surface of the metal layer 102, preferably with an adhesive. In addition to a foam material, the substrate material may be cardboard or pressboard or any other material having a porous surface capable of accepting an adhesive for adhering the siding trim piece to the structure. As used herein, the term "foam layer" or "foam" will be used to denote the foam, cardboard or pressboard material (or other equivalent materials) having such a porous surface.

The foam layer 104 preferably has a thickness generally equal to the depth of the trim channel 134 so that the porous interior surface is flush with the rear panel 114 and extension 118'. Preferably, the foam layer has a thickness of about 0.75 inches.

It is noted that the siding trim piece 100 with integral J channel of FIG. 2 is similar to the siding trim pieces 10 of FIGS. 1A-1D, the difference between the two embodiments being the width of the channel 34 or 134 between the first transverse panel 16 or 116 and the second transverse wall 18 or 118. Accordingly, the siding trim pieces of FIGS. 1A-1D can include an expanded trim channel like FIG. 2 with a foam layer 104 located therein, the expanded channel being used to cover the discontinuity in the exterior surface of the structure such as window or door trim, corners or edges, facia, soffits and frieze boards.

The use of the light gauge metal (in the range of 0.01 to 0.019 and preferably about 0.013) improves the ability of the trim piece to resist thermal expansion/contraction in relation to heavier gauge metals. Even though the light gauge metal is less stiff than heavier gauge metals, the foam layer provides additional structural rigidity to the panel. To further reduce thermal expansion/contraction, an intermediate elastic layer may be disposed between the light gauge layer and the foam layer, the intermediate layer being a rubber-like material which absorbs any movement due to thermal expansion/contraction of the light gauge layer, but does not transfer that movement to the foam layer.

Another advantage of the foregoing structure is that the porous interior surface of the foam layer can be fastened to the structure with adhesive. This simplifies trim construction since the trim piece can be cut to size and glued to the structure, when conventionally nails were required since an interior metal surface of the siding panel would not adhere to a metal or wood surface of the structure. (During the assembly operation, staples can be used to hold the siding trim piece in place until the adhesive cures.) The inventive trim piece 10, 100 also provides a smooth, painted wood-like appearance while retaining the advantages of siding and eliminating the aesthetic disadvantages of separate J channels and the structural disadvantages of thermal expansion/contraction.

Figure 3A:
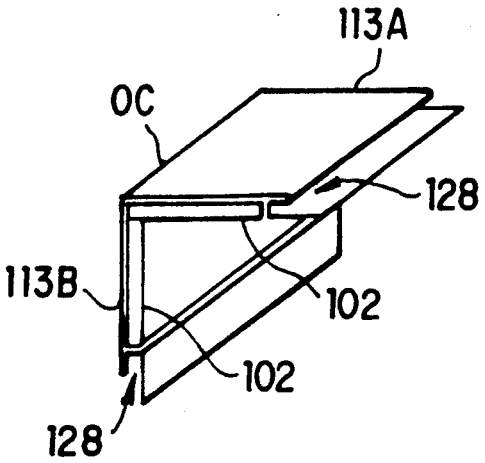
FIGS. 3A and 3B are horizontal perspective views of the siding trim piece of FIG. 2 adapted for outside and inside corners, respectively.
Figure 3B:
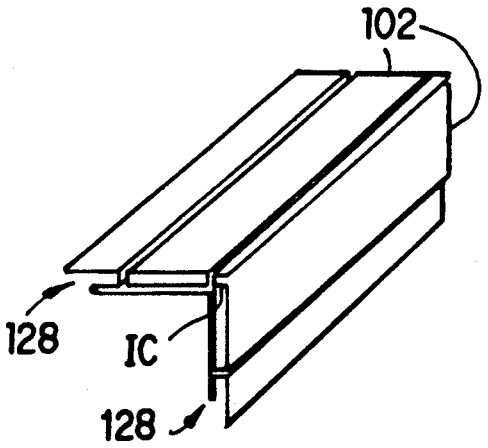
Figure 4:
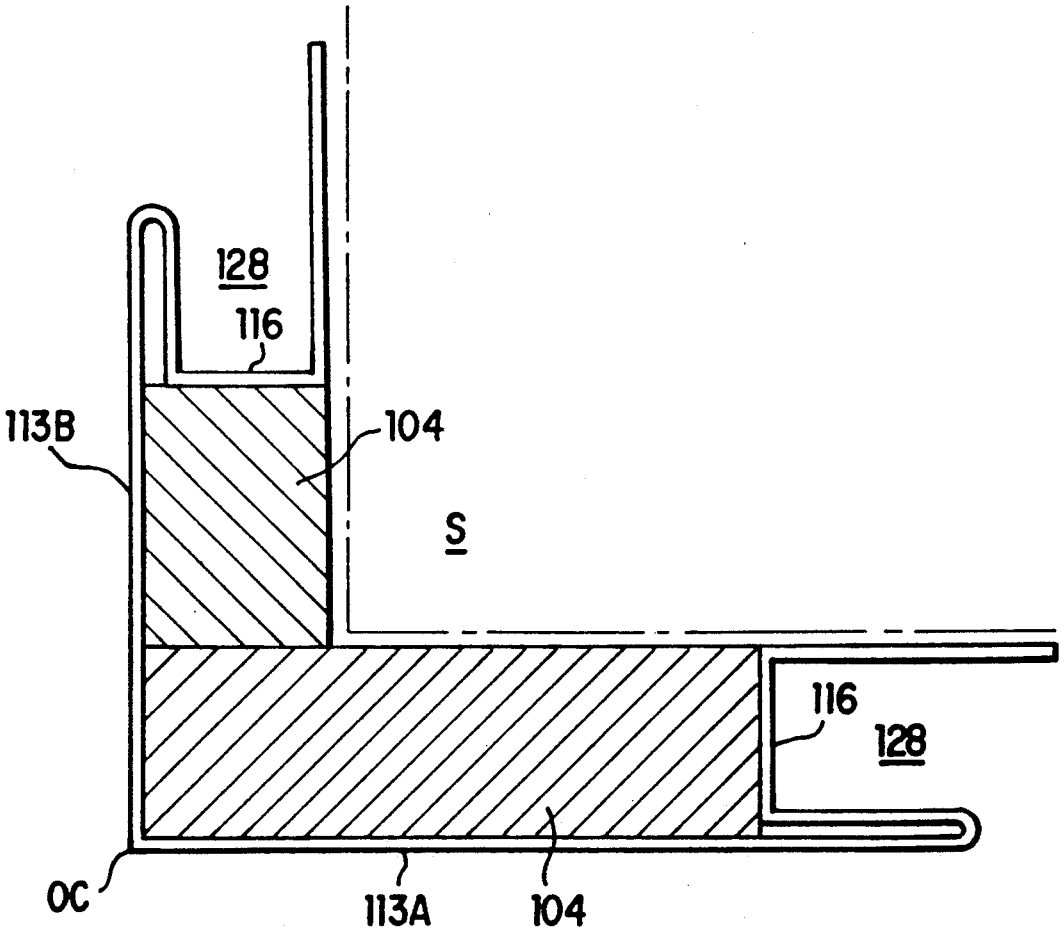
FIG. 4 is an enclosed cross-sectional vertical view of the outside corner of FIG. 3A for abutting ends of the siding panels into the integral J channel.

The siding trim piece 10, 100 with the integral J channel can be used in various forms. For example, the exterior face 13, 130 of the trim pieces in FIGS. 1D-2 can be bent to form the corner panels 100' of FIGS. 3A and 3B which can be employed for outside and inside corners, respectively. For example, in FIG. 3A, the exterior of face 113 is bent to form an outside corner OC, which defines two perpendicular exterior faces 113A, 113B. Each exterior face has a foam layer 104 laminated to its inside surface. Each edge of the exterior faces 113A, 113B opposite from the corner OC is provided with the integral J channel 128 formed as described above with respect to FIG. 1D or FIG. 2. FIG. 3B is similar to FIG. 3A, but illustrates an inside corner IC. The interior surface of the foam layer 104 in either the outside or inside corners of FIGS. 3A and 3B is adhered to the structure S as illustrated in FIG. 4, thus providing a smooth, painted wood-like appearance. The siding panels 30 are then inserted into the integral J channel, thus providing a smooth aesthetic appearance.

In known outside corner assemblies, a cap member is provided which has two nailing flanges on it. The cap is permanently fastened to the building with the J channels then being attached adjacent the cap before the siding panels are installed. This provides a nonuniform appearance since the J channel may provide a different aesthetic appearance from the cap and/or the siding panels 30. The present invention obviates this aesthetic difficulty by providing a trim piece with an integral J channel to obviate the appearance of a seam (formed by the nonintegral J channel) between the siding panel 30 and the cap.

Figure 5:
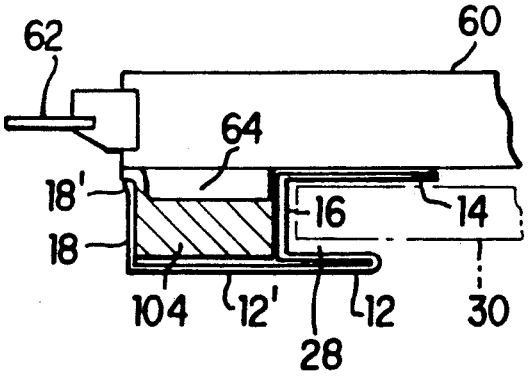
FIG. 5 is a cross-sectional view of a siding trim piece as part of a window trim assembly.

The trim pieces 10, 100 also have a unique and beneficial use relative to siding construction around windows, as well as doors. For ease of explanation, the invention will be described relative to use with window trim, but it is to be understood that the invention is equally applicable for use with door trim, or for trimming any other wall opening. As shown in FIG. 5, a wall 60 of a building has a window 62 in it. The foam layer 104 of the trim piece 10 is fixed to the window molding 64. The siding panels 30, which can be either horizontal of vertical panels, are positioned in place in the J shaped channel 28. When the molding 64 of the window 62 is covered with the siding material, the trim channel 34 covers the molding 64 with the extension 18' bent outwardly to cover the edge of the window casing.

In known window trim cover components, a trim component is nailed to the wall 60 to cover the molding 64. A nonintegral J channel is then attached adjacent the window molding. Thereafter, the wall siding panels are installed. The use of such a trim component provides a metallic non-wood-like appearance, and the intermediate J channel provides a nonuniform appearance between the window trim and the siding panel. The present invention thus improves the aesthetic appearance while maintaining the structural integrity of the siding by providing a trim piece with integral J channel which provides a wood-like appearance and obviates the appearance of a seam between the trim piece and the siding panel.

Figure 6A:
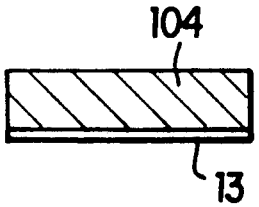
FIG. 6A is a cross-sectional view of a soffit siding panel of FIG. 6.
Figure 6:
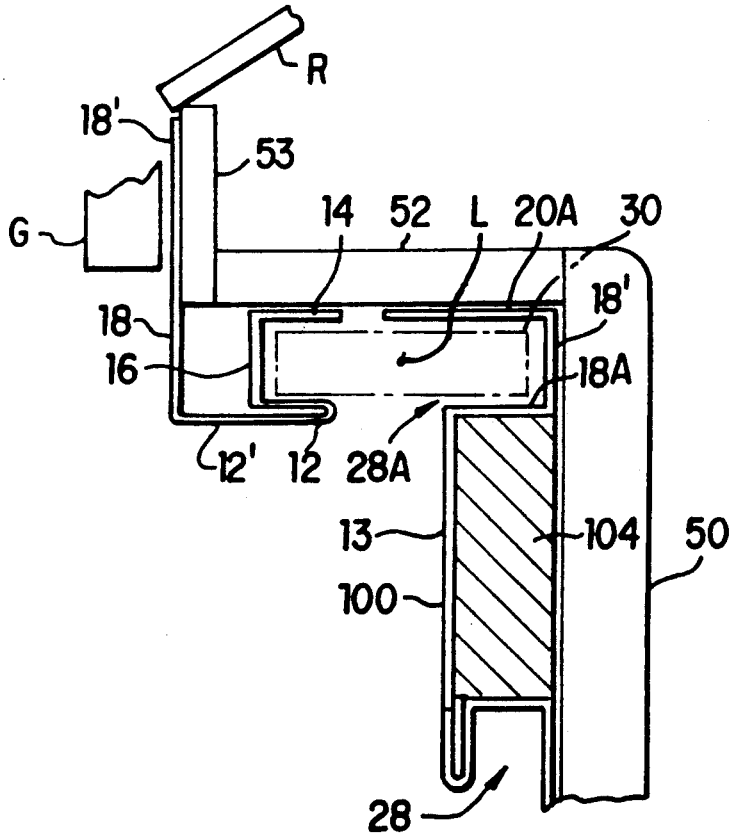
FIG. 6 is a cross-sectional view of a siding trim piece as part of a soffit/frieze/facia board assembly.

FIG. 6 is a cross-sectional view of the siding trim 10 as part of a soffit assembly. A vertical frieze board 50 intersects a soffit 52, which in turn intersects a facia board 53 for supporting a gutter G. The roof R is above the facia board 53. The trim piece 10 of FIG. 1C is adhered to the facia 53 to cover the facia board 53. The second integral J channel 28A extends along the soffit 52 to capture the siding piece 30 for covering the soffit 52.

The siding trim piece for the frieze board 30 is similar to the siding trim piece 100 of FIG. 2, but is adapted to accommodate an integral J channel rotated to parallel the soffit in a manner similar to FIG. 1C. More specifically, the siding trim piece for the frieze board 30 includes a siding trim piece 100' having a frieze panel 13. One edge of the frieze panel 13 includes the second integral J channel 28A of the present invention, the second J channel 28A being rotated 90° to open in the direction of the soffit and being defined by the third transverse panel 20A, second transverse panel 18A and extension 18A'. With this construction, the siding panel 30 is accommodated in the integral J channels 28 between the fascia trim piece 10 and the frieze siding trim piece 100', thus obviating the nonuniform appearance of a nonintegral J channel among the soffit siding, the facia trim and frieze board.

The soffit assembly of FIG. 6 is covered with a single panel 30, but the present invention permits a different architectural appearance for the soffit, such as a linear soffit or a plurality of linear soffit panels with a tongue and groove appearance. More specifically, conventional siding for soffits uses short siding panels whose longitudinal length extends between the fascia and frieze boards. The present invention provides a more wood-like appearance since linear siding soffit panels can be used which extend for the length of the structure. That is, the linear soffit panel can be arranged such that the longitudinal axis L is parallel to the structure, rather than the conventional short siding panels whose longitudinal length extends perpendicular to the structure and between the fascia and frieze boards.

For example, FIG. 6A illustrates the soffit panel 30 of FIG. 6 constructed like the trim pieces of FIG. 2 but without the integral J channels. If J channels are used, a plurality of panels can be employed in which one panel 30 is engaged in the J channel of the adjacent panel 30. Each panel is constructed of the low gauge layer with the foam layer laminated thereto. This structure permits the soffit panels to be fixed to the structure with an adhesive. The integral J channel conceals the seam between the panels. Further, since the material is constructed of the light gauge material with the laminated foam layer, thermal expansion/contraction is minimized, thereby permitting the longitudinal axis L of the soffit panels to be arranged parallel to the structure. The foregoing advantages are also applicable to the fascia and frieze board assemblies described above when using the principles of the present invention.

Figure 7:
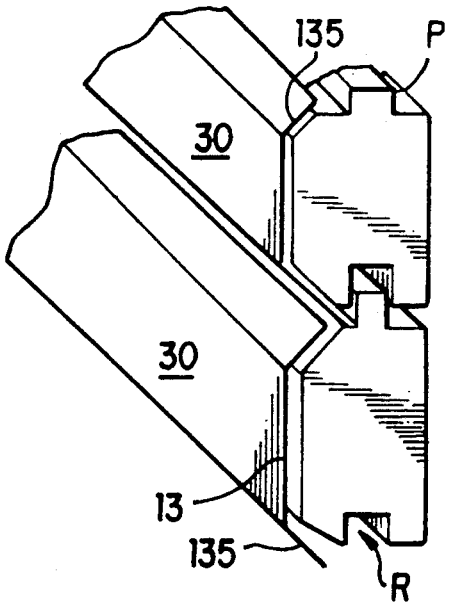
FIG. 7 is a perspective view of a tongue and groove arrangement for soffit and ceiling panels.

The soffit panel construction of FIG. 6 is adaptable to other forms such as ceiling panels. Further, the soffit or ceiling panels can be modified to provide a tongue and groove appearance as illustrated in FIG. 7 which for simplicity illustrates two engaged panels. The exterior face 13 of the light gauge material is beveled on each side 13S. One side of the foam layer 104 includes a projection P which engages a recess in the adjacent panel, thereby providing a tongue and groove appearance.

It is often desirable to alter the appearance of a structure by changing the trim on the building to that of a different color, type or texture. In the past, such a change has required removal of the existing trim. The present invention, however, obviates this disadvantage by providing a snap-on trim assembly described below with reference to FIGS. 8 and 9.

Figure 8:
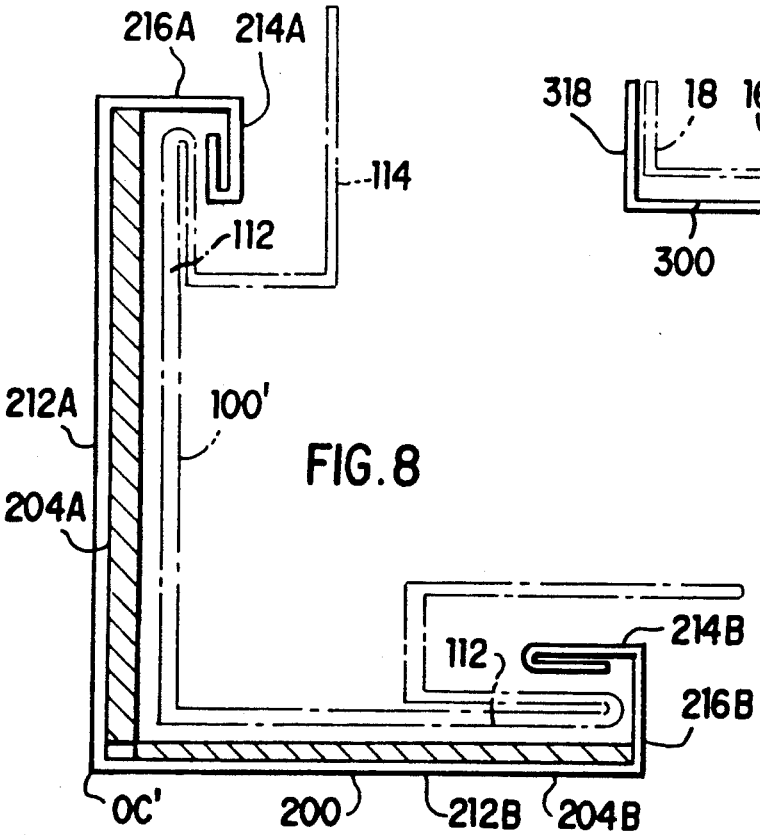
FIG. 8 is a cross-sectional view of a snap-on cover trim component cooperating with the corner panel of FIG. 7.

FIG. 8 illustrates a cross-section of a snap-on corner trim component 200. The component 200 preferably is a panel bent to form an outside corner OC' (inside corners are also possible) which defines two exterior or front component panels 212A, 212B. The edge of each panel 212A, 212B is bent for forming a transverse component wall 216A, 216B and a rear component wall 214A, 214B, the edge of which is bent back against the interior surface of the rear wall 214A, 214B. A foam layer 204A, 204B is located on an interior surface of the front panels 212A, 212B. The corner component 200 cooperates with the corner panel 100' of FIG. 4 (shown in phantom in FIG. 8 without foam layer 104) by snapping the rear walls 214A, 214B underneath the front panels 112 of the J channel. The corner component can thus alter the appearance of the building without removal of the existing trim or siding panels.

Figure 9:
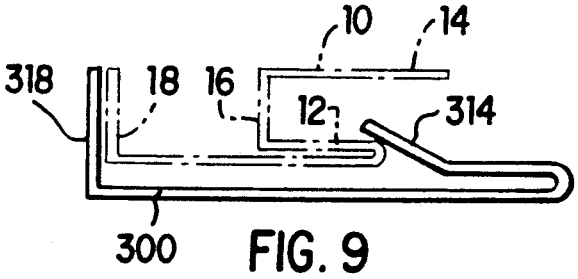
FIG. 9 is a cross-sectional view of a snap-on window or trim component cooperating with the trim piece of FIG. 5.

The principles of FIG. 8 are adaptable to a snap-on window (or door) trim component 300 which covers the trim piece 10 of FIG. 5 (shown in phantom in FIG. 9). The trim component 300 preferably comprises an elongated strip bent an one edge to form a transverse component wall 31B and folded over at an opposite edge to form a rear component wall 314. In use, the rear component wall 314 is snapped behind the front wall 12 of the trim piece 10 while the transverse component wall 318 is located over the second transverse wall 1B of the trim piece 10.

The invention has been described with reference to the preferred embodiments thereof, which preferred embodiments are intended to be illustrative and not limiting. Modifications and changes may be made without departing from the spirit and scope of the invention as defined in the appended claims.

What is claimed is:

1. A siding trim piece for attachment to a surface of a structure comprising:

a low gauge relatively flexible layer defining a longitudinal axis and a transverse axis perpendicular to the longitudinal axis, and having a gauge between 0.010 and 0.013 for resisting thermal dimensional changes along the longitudinal axis relative to a stiffer heavy gauge layer, the low gauge layer defining external and internal surfaces; and a substrate material having a first surface laminated to the internal surface of the low gauge layer and a second porous surface for attachment to the surface of the structure, the substrate material laminated to the low gauge layer providing structural rigidity to the low gauge layer along the longitudinal and transverse axes.

2. The siding trim piece of claim 1, wherein the low gauge layer is a metal layer.

3. The siding trim piece of claim 1, wherein the low gauge layer has a gauge of about 0.013.

4. The siding trim piece of claim 1, wherein the substrate material is pressboard laminated to the low gauge layer.

5. The siding trim piece of claim 1, wherein the substrate material is pressboard laminated to the low gauge layer.

6. The siding trim piece of claim 1, wherein the substrate material is cardboard laminated to the low gauge layer.

7. The siding trim piece of claim 1, wherein intermediate elastic layer means is disposed between the low gauge layer and the substrate material for absorbing movement due to thermal dimensional changes of the low gauge layer.

8. The siding trim piece of claim 7, wherein the intermediate layer means is a rubber-like material.

9. The siding trim piece of claim 1, wherein the low gauge layer includes first and second edges with at least one of the first and second edges having a transverse wall transverse to the external surface of the low gauge layer, the transverse wall defining an external channel with a seam covering section on one side of the transverse wall and an internal channel on an opposite side of the transverse wall, the substrate material being located in the internal channel.

10. The siding trim piece of claim 9, wherein the internal channel is a J channel.

11. The siding trim piece of claim 9, wherein the exterior channel opens in a first direction parallel to the surface of the structure.

12. The siding trim piece of claim 9, wherein the exterior channel opens in a second direction perpendicular to the surface of the structure.

13. The siding trim piece of claim 9, wherein each of the first and second edges has a transverse wall defining on each of the first and second edges an external channel with a seam covering section, the internal channel being located between the external channels.

14. The siding trim piece of claim 13, wherein each exterior channel is a J channel.

15. The siding trim piece of claim 13, wherein a first direction is defined parallel to the surface of the structure and a second opposite direction is defined perpendicular to the surface of the structure, the exterior channels on both the first and second edges opening in the same direction.

16. The siding trim piece of claim 15, wherein the same direction is the first direction.

17. The siding trim piece of claim 13, wherein a first direction is defined parallel to the surface of the structure and a second direction is defined perpendicular to the surface of the structure, one of the exterior channels opening in the first direction and the other exterior channel opening in the second direction.

18. The siding trim piece of claim 17, wherein the siding trim piece is a frieze board.

19. A siding trim piece for siding construction using siding elements on a structure, comprising:

an elongated relatively flexible sheet defining a longitudinal axis and a transverse axis perpendicular to the longitudinal axis, and having a gauge between 0.010 and 0.013 for resisting thermal dimensional changes along the longitudinal axis relative to a stiffer heavy gauge sheet, said sheet defining a rear panel, a first transverse wall integral with the rear panel and extending outwardly therefrom, a front panel integral with the first transverse wall and extending generally parallel to the rear panel, and a second transverse wall integral with the front panel and extending inwardly therefrom in a direction parallel to the first transverse wall;

the first transverse wall and the rear panel cooperating to define an external integral channel on one side of the first transverse wall for retaining a siding element; and the first and second traverse walls cooperating to define an integral internal channel on an opposite side of the first traverse wall, the internal channel enclosing a substrate material laminated to an interior surface of the first wall, the substrate material laminated to the low gauge sheet providing structural rigidity to the low gauge sheet along the longitudinal and transverse axes.

20. The siding trim piece of claim 19, wherein the internal channel is sized to cover a trim structure projecting from the surface of the structure.

21. A frieze, soffit and facia assembly for covering a frieze board, soffit and fascia board of a structure, comprising:

a frieze element for covering the frieze board, at least one soffit element for covering the soffit, and a facia element for covering the facia board; each element comprising a low gauge relatively flexible layer defining a longitudinal axis and a transverse axis perpendicular to the longitudinal axis and having a gauge between 0.010 and 0.013 for resisting thermal dimensional changes along the longitudinal axis relative to a stiffer, heavy gauge layer, the low gauge layer defining external and internal surfaces; and a substrate material having a first surface laminated to the internal surface of the low gauge layer and a second porous surface for attachment to the surface of the structure, the substrate material laminated to the low gauge layer prodding structural rigidity to the low gauge layer along the longitudinal and transverse axes;

the facia and frieze elements having an edge formed into an external channel with a seam covering section, the external channel of the facia element opening toward the external channel of the frieze element;

the soffit element being captured between the external channels of the facia and frieze elements with the seam covering sections covering spaces between the soffit element and the facia and frieze element, the transverse axis of the soffit element extending between the external channels of the facia and frieze elements so that the longitudinal axes of the facia, frieze and soffit element are aligned in the same direction.

22. The frieze soffit and facia assembly of claim 21, wherein the at least one soffit element is a plurality of interconnected soffit elements, each of said plurality of soffit elements having a first longitudinal edge with a longitudinally extending tongue projecting therefrom and a second longitudinal edge with a longitudinally extending groove recessed therein, the tongue of one soffit element being received in the groove of an adjacent soffit element to interconnect the soffit elements between the external channels of the facia and frieze boards.

* * * * *